US006419447B1

(12) United States Patent
Watanabe et al.

(10) Patent No.: US 6,419,447 B1
(45) Date of Patent: Jul. 16, 2002

(54) GAS TURBINE EQUIPMENT AND TURBINE BLADE

(75) Inventors: Koji Watanabe; Masaaki Matsuura; Kiyoshi Suenaga, all of Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 9 days.

(21) Appl. No.: 09/685,950

(22) Filed: Oct. 12, 2000

(30) Foreign Application Priority Data

Nov. 19, 1999 (JP) ..... 11-329965

(51) Int. Cl.[7] ..... F01D 5/18; F01D 9/04

(52) U.S. Cl. ..... 415/191; 415/115; 415/208.2; 415/210.1; 416/96 R; 416/97 R; 416/193 A

(58) Field of Search ..... 416/193 A, 96 R, 416/96 A, 97 R, 248; 415/115, 116, 191, 208.1, 208.2, 210.1, 193, 209.2; 29/889, 889.7, 889.72, 889.721

(56) References Cited

U.S. PATENT DOCUMENTS 4,050,843 A * 9/1977 Needham et al. ..... 415/116
4,088,421 A * 5/1978 Hoeft ..... 416/193 A
5,188,507 A 2/1993 Sweeney
5,243,759 A * 9/1993 Brown et al. ..... 29/889.721
5,271,718 A * 12/1993 Mitchell, Jr. et al. .... 416/193 A
5,358,379 A * 10/1994 Pepperman et al. ..... 415/191
5,947,687 A 9/1999 Mori et al.
6,190,128 B1 * 2/2001 Fukuno et al. ..... 416/96 R

FOREIGN PATENT DOCUMENTS

GB 2002460 A * 2/1979 ..... 416/193 A
JP 2961065 7/1999

* cited by examiner

*Primary Examiner*—Christopher Verdier
(74) *Attorney, Agent, or Firm*—Wenderoth, Lind & Ponack, L.L.P.

(57) ABSTRACT

Turbine blade of gas turbine etc. and gas turbine equipment using the turbine blade suppress occurrence of thermal stress caused by temperature difference and provide high reliability. In gas turbine equipment comprising rotational portion of rotor (1) and moving blade (2), stationary portion of casing (3), stationary blade (4), various supporting members, etc. and combustor, thermal stress reducing portion is provided in any one or both of moving blade joint adjacent portion (14*a*) between moving blade trailing edge portion (14) and platform (15) and stationary blade joint adjacent portion (20*a*) between stationary blade trailing edge portion (20) and shroud (18, 19). By the thermal stress reducing portion, undesirable thermal stress occurring in the blade joint adjacent portions (14*a*, 20*a*) is reduced and reliability of the turbine blade and the gas turbine equipment is enhanced.

6 Claims, 7 Drawing Sheets

GAS TURBINE EQUIPMENT AND TURBINE BLADE

BACKGROUND OF THE INVENTION

1. Field of the Invention

The present invention relates to a turbine blade of a gas turbine or the like and a gas turbine equipment using this turbine blade.

2. Description of the Prior Art

FIG. 5 is a schematic explanatory view of a structure of a turbine portion and a cooling air system for cooling this turbine portion in a gas turbine equipment in the prior art.

The turbine portion comprises a rotational portion of a rotor 1 and a turbine moving blade 2 and a stationary portion 5 of a casing 3, a turbine stationary blade 4, various supporting members and the like.

In the turbine portion, a high temperature high pressure combustion gas supplied from a combustor 6 is converted into a high velocity flow by the turbine stationary blade 4 to rotate the turbine moving blade 2 for generation of power.

Construction members of the rotational portion and the stationary portion which are adjacent to the combustion gas need to be cooled so that their temperature due to heat input from the combustion gas may not exceed their respective allowable temperature and, for cooling of the rotational portion having the rotor 1 and the turbine moving blade 2, it is usual that cooling medium 7 is supplied as shown by arrows in FIG. 5.

The cooling medium 7 is often a bleed air or discharge air taken from a compressor (not shown) or sometimes the bleed air or discharge air once supplied into a cooler (not shown) and cooled to an appropriate temperature.

Further, as the cooling medium to cool the mentioned portions, there is recently a case where steam from an outside system is applied in place of the bleed air or discharge air from the compressor, but herebelow description will be made based on the cooling air system which is generally employed as a typical example.

While the cooling medium 7 flowing in the rotational portion takes a route to flow through an interior of the rotor 1 to enter an interior of the turbine moving blade 2 for cooling thereof and then to join into a combustion gas path, in the case of using steam as the cooling medium as mentioned above, the cooling medium which has been heat-exchanged by cooling the turbine moving blade 2 and the like is recovered so that thermal energy thereof may be made use of in an outside system and thermal efficiency of the plant may be enhanced.

In the gas turbine equipment having the mentioned basic structure, description will be made concretely on the prior art turbine portion thereof with reference to FIGS. 6 to 10.

FIG. 6 is a longitudinal cross sectional view showing a main structure of a prior art turbine moving blade, FIG. 7 is a perspective view showing a main structure of a prior art turbine stationary blade, FIG. 8 is an enlarged view of a part of the turbine stationary blade of FIG. 7, FIG. 9 is a qualitative explanatory view showing a metal temperature behavior due to thickness difference between thickness of a turbine moving blade trailing edge portion and that of a platform in the prior art, and FIG. 10 is likewise a qualitative explanatory view showing a metal temperature behavior due to thickness difference between thickness of a turbine stationary blade trailing edge portion and that of a shroud in the prior art.

In a leading edge portion of the turbine moving blade 2 which is exposed to an especially high temperature combustion gas, in order to stand a high thermal load, it is usual to provide a cooling passage 8 through which the cooling medium 7 is supplied for effecting a convection cooling in the turbine moving blade 2.

Cooling passage in the moving blade is often constructed to repeat several turnings so as to form a serpentine passage on design demand, wherein the passage turns at a turning portion 11 provided in the vicinity of a tip portion 9 of the turbine moving blade 2 and a joint portion 10 of the turbine moving blade 2.

Thus, the cooling medium 7 flows through the cooling passages to cool the interior of the turbine moving blade 2. However, in case the turbine moving blade 2 is one which receives higher thermal load, there is provided a film cooling hole 12 in a blade surface of the turbine moving blade 2 and a portion of the cooling medium 7 is blown therethrough onto the blade surface on the combustion gas path side so that the blade surface may be covered by a low temperature air curtain and thereby a film cooling for reducing the thermal load from the blade surface as well can be effected.

On the other hand, a trailing edge portion 14 of the turbine moving blade 2 is usually designed to be relatively thin in order to reduce an aerodynamic loss of the combustion gas and, for this purpose, if the turbine moving blade 2 is to be cooled, a pin fin cooling or a slot cooling by way of many slots is employed for cooling the interior of the blade, or the film cooling by way of blowing air from a ventral side surface of the blade through the film cooling hole is effected.

In case of the turbine stationary blade 16, in order to form a gas flow path, structure of the blade is made such that an inner end of a blade profile portion 17 is inserted into an inner shroud 18 and an outer end of the blade profile portion 17 is inserted into an outer shroud 19, and while this set of one inner shroud 18 and one outer shroud 19 is usually provided for each of the turbine stationary blades 16, there is also such a case where the set of one inner shroud 18 and one outer shroud 19 is provided so as to cover a plurality of the turbine stationary blades 16.

The turbine stationary blade 16 is usually formed by precision casting and is then worked by machining, wherein the inner shroud 18, the outer shroud 19 and the blade profile portion 17 are generally formed integrally by casting.

As mentioned above, the platform 15 supporting the turbine moving blade 2 forms a part of the gas flow path in an axial flow turbine and is made relatively thicker as compared with the trailing edge portion 14 of the blade so as to stand centrifugal force or the like.

For this reason, in operation of the gas turbine including start and stop, load change or the like, there may arise an excessively large temperature difference between the platform 15 and the blade trailing edge portion 14, by which thermal stress is liable to occur at a transition time or in a steady operation time so that there is a risk to cause cracks and if the cracks occur, there is a problem to damage a reliability of the turbine moving blade.

Also, in the turbine stationary blade 16, in order to reduce an aerodynamic loss, a trailing edge portion 20 of the blade is designed as thin as possible and, on the other hand, the inner shroud 18 and the outer shroud 19 are usually designed relatively thicker for holding the strength. Thus, like the turbine moving blade 2, there is a problem that cracks are considered to occur by the thermal stress following a start and stop of the gas turbine or the like, which results in damaging the reliability.

The mentioned relation between the moving blade trailing edge portion and the platform is shown in FIG. 9 qualitatively as a metal temperature behavior which is caused by a thickness difference between thickness of the moving blade trailing edge portion and that of the platform. Likewise, the mentioned relation between the stationary blade trailing edge portion and the shroud is shown in FIG. 10 qualitatively as a metal temperature behavior which is caused by a thickness difference between thickness of the stationary blade trailing edge portion and that of the shroud.

In FIGS. 9 and 10, the vertical axis means a gas turbine rotational speed and metal temperature and the horizontal axis means a lapse of time. When the gas turbine is stopped, gas turbine rotational speed $C_1$, $C_2$ is reduced. In the area of $C_1$ and $C_2$, the blade trailing edge portion which is of a smaller thermal capacity is cooled quicker and moving blade trailing edge portion metal temperature $B_1$ and stationary blade trailing edge portion metal temperature $B_2$ are reduced largely. On the contrary, the platform and the shroud are of a larger thermal capacity, respectively, and platform metal temperature $A_1$ and shroud metal temperature $A_2$ are reduced comparatively slowly. Hence, temperature difference $\alpha t$ between both portions becomes larger and a problem of occurrence of thermal stress arises there.

SUMMARY OF THE INVENTION

Thus, in order to solve the problem in the prior art, it is an object of the present invention to provide highly reliable moving blade and stationary blade which are able to suppress an occurrence of thermal stress caused by the mentioned temperature difference as well as to provide a gas turbine equipment comprising these moving blade and stationary blade.

In order to solve the mentioned problem in the prior art, the present invention provides the following first means:

A gas turbine equipment comprising a rotational portion of a rotor and a moving blade, a stationary portion of a casing, a stationary blade, various supporting members and the like and a combustor, characterized in that there is provided a thermal stress reducing portion in any one or both of a moving blade joint adjacent portion between a moving blade trailing edge portion and a platform and a stationary blade joint adjacent portion between a stationary blade trailing edge portion and a shroud.

According to the mentioned first means, the thermal stress reducing portion is provided in any one or both of the moving blade joint adjacent portion between the moving blade trailing edge portion and the platform and the stationary blade joint adjacent portion between the stationary blade trailing edge portion and the shroud, and thereby the undesirable thermal stress is reduced in these joint adjacent portions and the reliability of the gas turbine equipment can be enhanced.

Also, the present invention provides the following second means:

A gas turbine equipment as mentioned in the first means, characterized in that the thermal stress reducing portion provided in the moving blade joint adjacent portion is formed such that the platform in the moving blade joint adjacent portion is partially cut away and a remaining thickness of the platform so cut away is approximately same as a thickness of the moving blade trailing edge portion.

According to the mentioned second means, the thermal stress reducing portion is formed in such a structure that the platform in the moving blade joint adjacent portion between the moving blade trailing edge portion and the platform is partially cut away and a remaining thickness of the platform so cut away is approximately same as a thickness of the moving blade trailing edge portion, and thereby the undesirable thermal stress is surely reduced by the simply workable means and the reliability of the gas turbine equipment can be enhanced.

Also, the present invention provides the following third means:

A gas turbine equipment as mentioned in the first means, characterized in that the thermal stress reducing portion provided in the stationary blade joint adjacent portion is formed such that the shroud in the stationary blade joint adjacent portion is thinned and a remaining thickness of the shroud so thinned is approximately same as a thickness of the stationary blade trailing edge portion.

According to the mentioned third means, the thermal stress reducing portion is formed in such a structure that the shroud in the stationary blade joint adjacent portion between the stationary blade trailing edge portion and the shroud is thinned and a remaining thickness of the shroud so thinned is approximately same as a thickness of the stationary blade trailing edge portion, and thereby the undesirable thermal stress is surely reduced by the simply workable means and the reliability of the gas turbine equipment can be enhanced.

Also, the present invention provides the following fourth means:

A turbine blade comprising a moving blade joint adjacent portion between a moving blade trailing edge portion and a platform, characterized in that the platform in the moving blade joint adjacent portion is partially cut away and a remaining thickness of the platform so cut away is approximately same as a thickness of the moving blade trailing edge portion.

According to the mentioned fourth means, the structure is employed such that the platform in the moving blade joint adjacent portion between the moving blade trailing edge portion and the platform is partially cut away and a remaining thickness of the platform so cut away is approximately same as a thickness of the moving blade trailing edge portion, and thereby the undesirable thermal stress occurring in the moving blade joint adjacent portion is reduced and the reliability of the turbine blade can be enhanced.

Also, the present invention provides the following fifth means:

A turbine blade comprising stationary blade inner and outer joint adjacent portions between a stationary blade trailing edge portion and an inner shroud and between said stationary blade trailing edge portion and an outer shroud, respectively, characterized in that each of the inner shroud in the stationary blade inner joint adjacent portion and the outer shroud in the stationary blade outer joint adjacent portion is thinned and a remaining thickness each of the inner shroud and the outer shroud so thinned is approximately same as a thickness of the stationary blade trailing edge portion.

According to the mentioned fifth means, the structure is employed such that each of the inner shroud in the stationary blade inner joint adjacent portion between the stationary blade trailing edge portion and the inner shroud and the outer shroud in the stationary blade outer joint adjacent portion between the stationary blade trailing edge portion and the outer shroud is thinned and a remaining thickness each of the inner shroud and the outer shroud so thinned is approximately same as a thickness of the stationary blade trailing edge portion, and thereby the undesirable thermal stress occurring in the stationary blade inner and outer joint adjacent portions is reduced and the reliability of the turbine blade can be enhanced.

Further, the present invention provides the following sixth means:

A gas turbine equipment comprising the turbine blade mentioned in the fourth means and that mentioned in the fifth means.

According to the mentioned sixth means, the structure is employed such that, on the moving blade side, the platform in the moving blade joint adjacent portion between the moving blade trailing edge portion and the platform is partially cut away and, on the stationary blade side, each of the inner shroud in the stationary blade inner joint adjacent portion between the stationary blade trailing edge portion and the inner shroud and the outer shroud in the stationary blade outer joint adjacent portion between the stationary blade trailing edge portion and the outer shroud is thinned, and thereby the undesirable thermal stress occurring both on the moving blade side and on the stationary side is reduced and the reliability of the gas turbine equipment can be enhanced.

DESCRIPTION OF THE PREFERRED EMBODIMENTS

A first embodiment according to the present invention will be described with reference to FIGS. 1 and 2.

Figure 1:
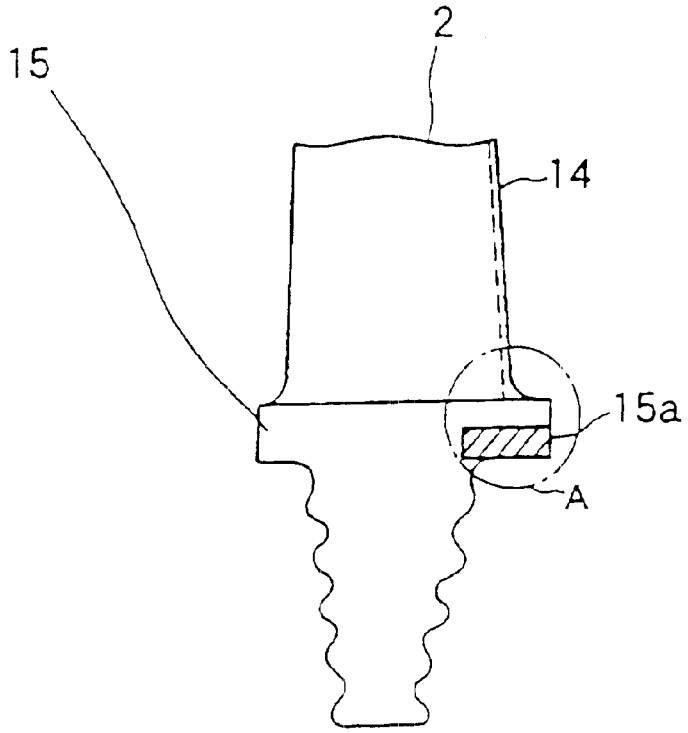
FIG. 1 shows an outline of a turbine moving blade of a first embodiment according to the present invention and FIG. 1(*a*) is a side view of the turbine moving blade including portion A which is a thinned portion of a platform adjacent to a trailing edge portion of the turbine moving blade and FIG. 1(*b*) is an enlarged perspective view showing the portion A of FIG. 1(*a*).
Figure 1:
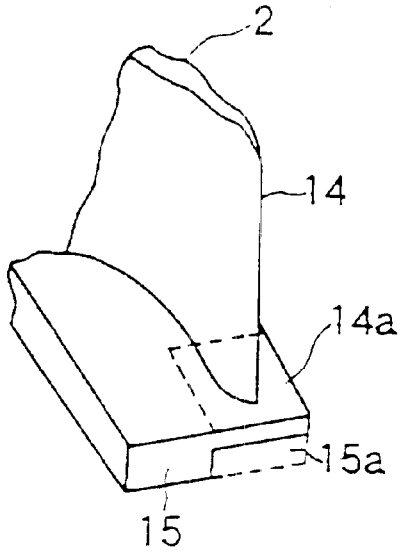

FIG. 1 shows an outline of a turbine moving blade of the first embodiment according to the present invention, and FIG. 1(*a*) is a side view of the turbine moving blade including portion A which is a thinned portion of a platform adjacent to a trailing edge portion of the turbine moving blade and FIG. 1(*b*) is an enlarged perspective view showing the portion A of FIG. 1(*a*). FIG. 2 is an explanatory view showing a temperature difference between metal temperature of the trailing edge portion and that of the platform of the turbine moving blade of FIG. 1.

In the present embodiment, a portion of a platform 15 in a joint adjacent portion 14*a* in which the platform 15 and a blade trailing edge portion 14 are jointed together is cut away with a cut-away portion 15*a* being removed so that a metal thickness there is partially thinned to approach to a metal thickness of the blade trailing edge portion 14.

That is, in the present embodiment, a portion on a blade root side of the platform 15 in the joint adjacent portion 14*a* in which the platform 15 and the blade trailing edge portion 14 are jointed together is cut away and the cut-away portion 15*a* is removed so that the metal thickness there is thinned to be approximately same as the thickness of the blade trailing edge portion 14. Thereby, the thermal capacity difference there is reduced and not only a uniform metal temperature is maintained in a steady operation time but also the temperature difference between the blade trailing edge portion 14 and the platform 15 is reduced even in a variation time of combustion gas flow condition following a gas turbine start or stop. Hence the thermal stress caused by the temperature difference can be reduced and life of the turbine blade can be enhanced greatly.

Figure 2:
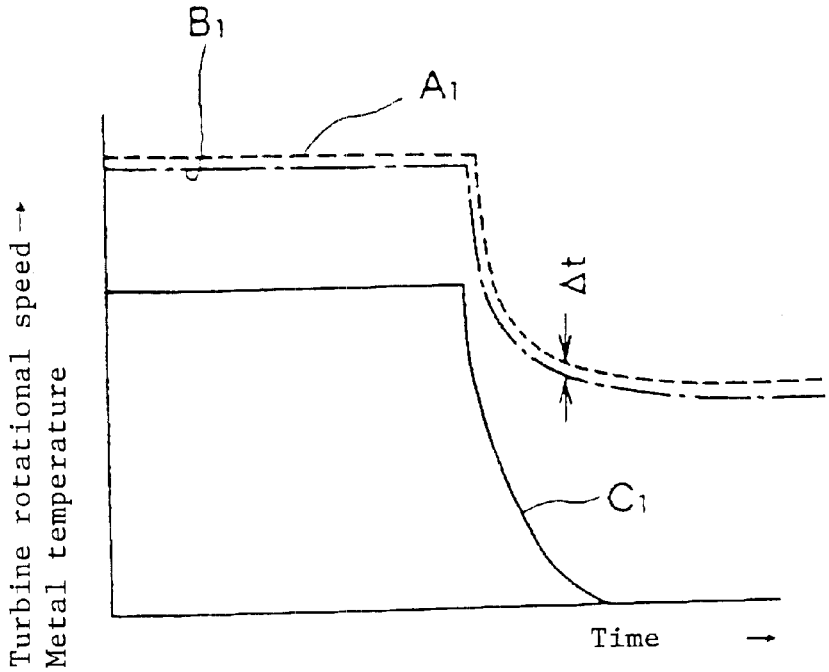
FIG. 2 is an explanatory view showing a temperature difference between metal temperature of the moving blade trailing edge portion and that of the platform.

FIG. 2 is a view showing an effect of the thinning of the platform wherein a metal temperature behavior of the blade trailing edge portion 14 and the platform 15 at the time of stop of the gas turbine as an example is shown qualitatively.

In FIG. 2, following a reduction of gas turbine rotational speed $C_1$, both platform metal temperature $A_1$ and moving blade trailing edge metal temperature $B_1$ are reduced and, in the present embodiment, the thinned portion is provided in the platform 15 as mentioned above and hence temperature difference $\Delta t$ between the platform 15 and the blade trailing edge portion 14 is small and thermal capacity is nearly same in these respective portions. Accordingly, even in a transitional behavior change, such as stop of gas turbine, the temperature difference hardly occurs, the thermal stress caused by the temperature difference can be reduced and the reliability can be enhanced remarkably.

It is to be noted that if the platform 15 is made thin, it is worried that the platform 15 may hardly stand centrifugal force acting on the turbine moving blade 2 but as the blade trailing edge portion functions as a beam to receive the centrifugal force in the vicinity of the blade trailing edge portion 14, thinning of the platform portion becomes possible.

Also, while the cut-away portion 15*a* on the blade root side of the platform 15 is formed in a step shape in the present embodiment, the cut-away portion 15*a* is not limited to the step shape as illustrated but may be formed so that the metal thickness of the platform 15 increases toward a combustion gas flow upstream side from near the blade trailing edge portion.

Next, a second embodiment according to the present invention will be described with reference to FIGS. 3 and 4.

Figure 3:
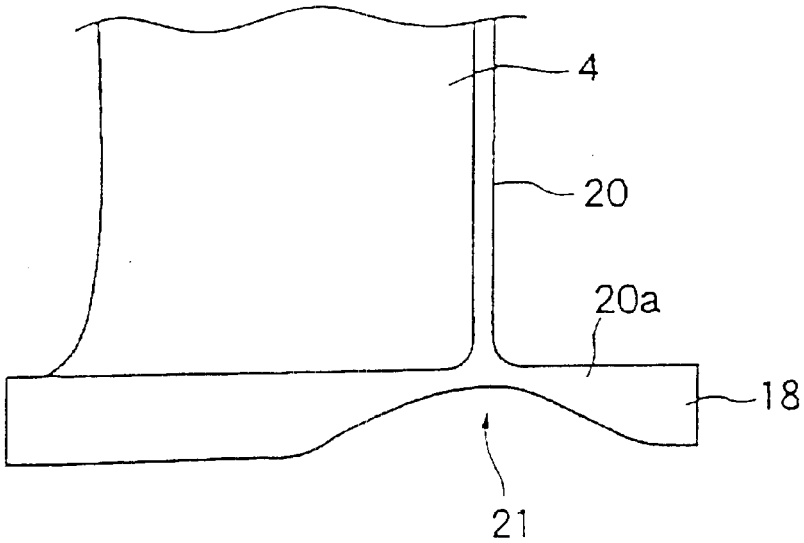
FIG. 3 is an enlarged side view showing a thinned portion of a shroud adjacent to a turbine stationary blade of a second embodiment according to the present invention.
Figure 4:
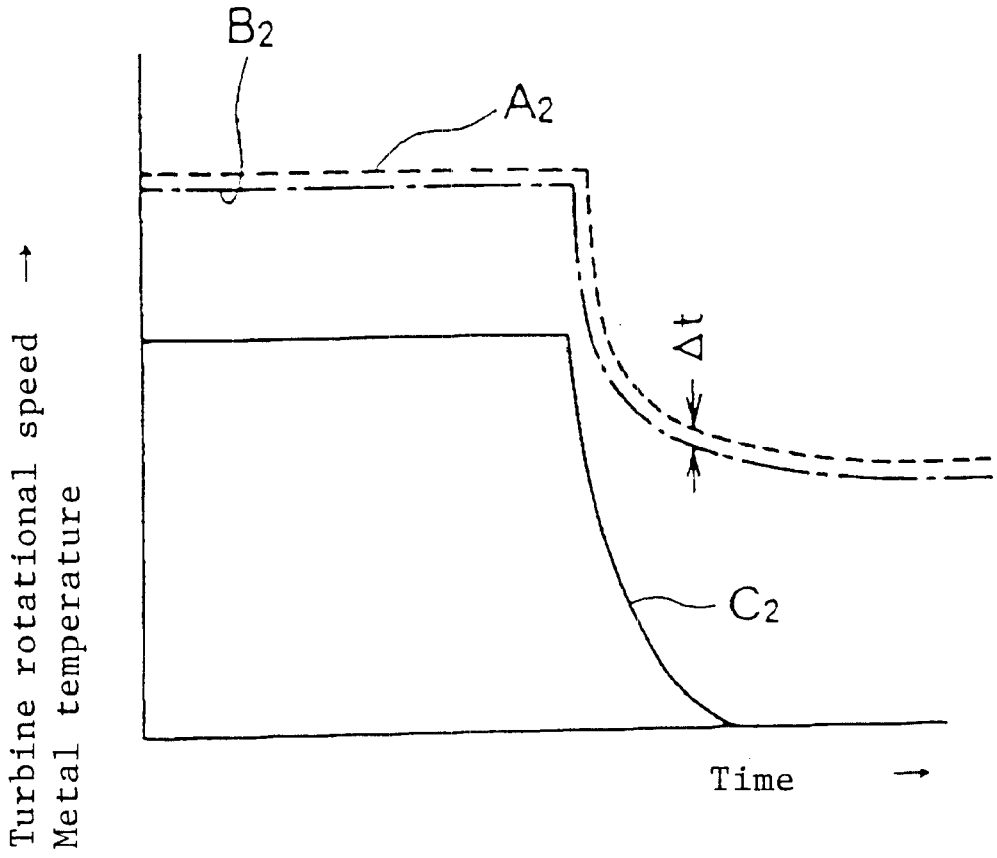
FIG. 4 is an explanatory view showing a temperature difference between metal temperature of a stationary blade trailing edge portion and that of the shroud of the turbine stationary blade of FIG. 3.
Figure 5:
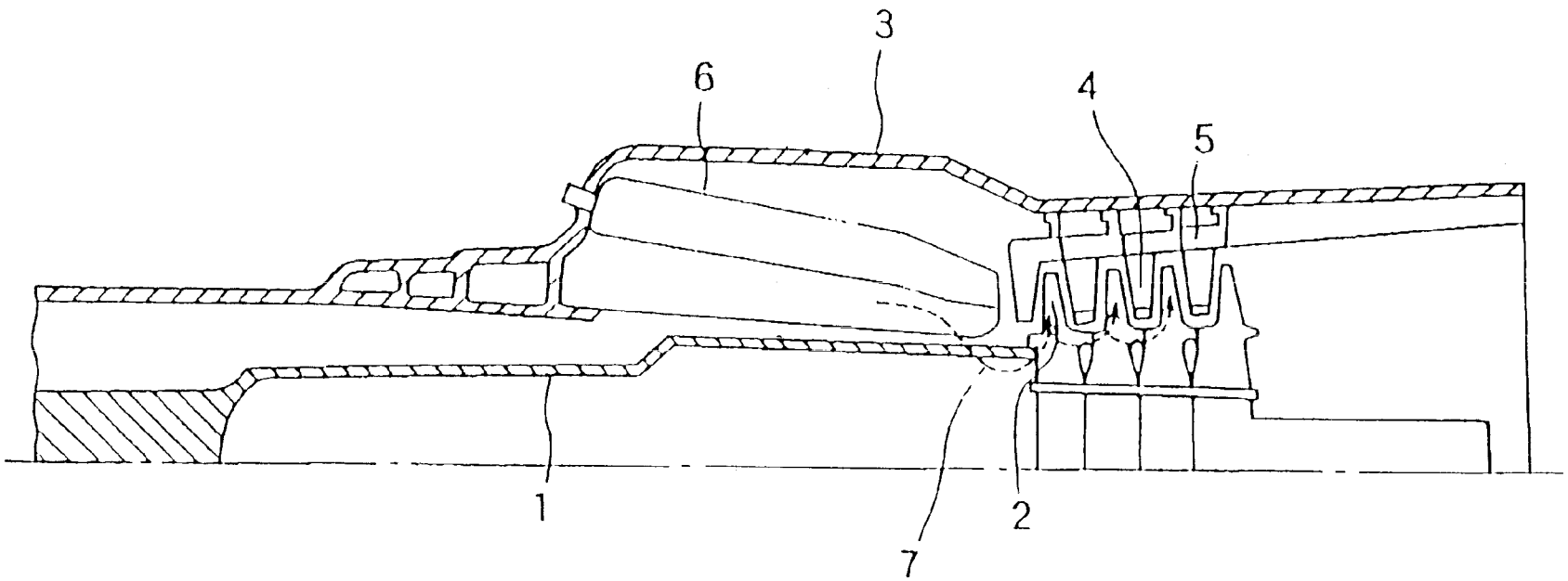
Fig. 5 (Prior Art)
FIG. 5 is a schematic explanatory view of a structure of a turbine portion and a cooling air system for cooling this turbine portion in a gas turbine equipment in the prior art.
Figure 6:
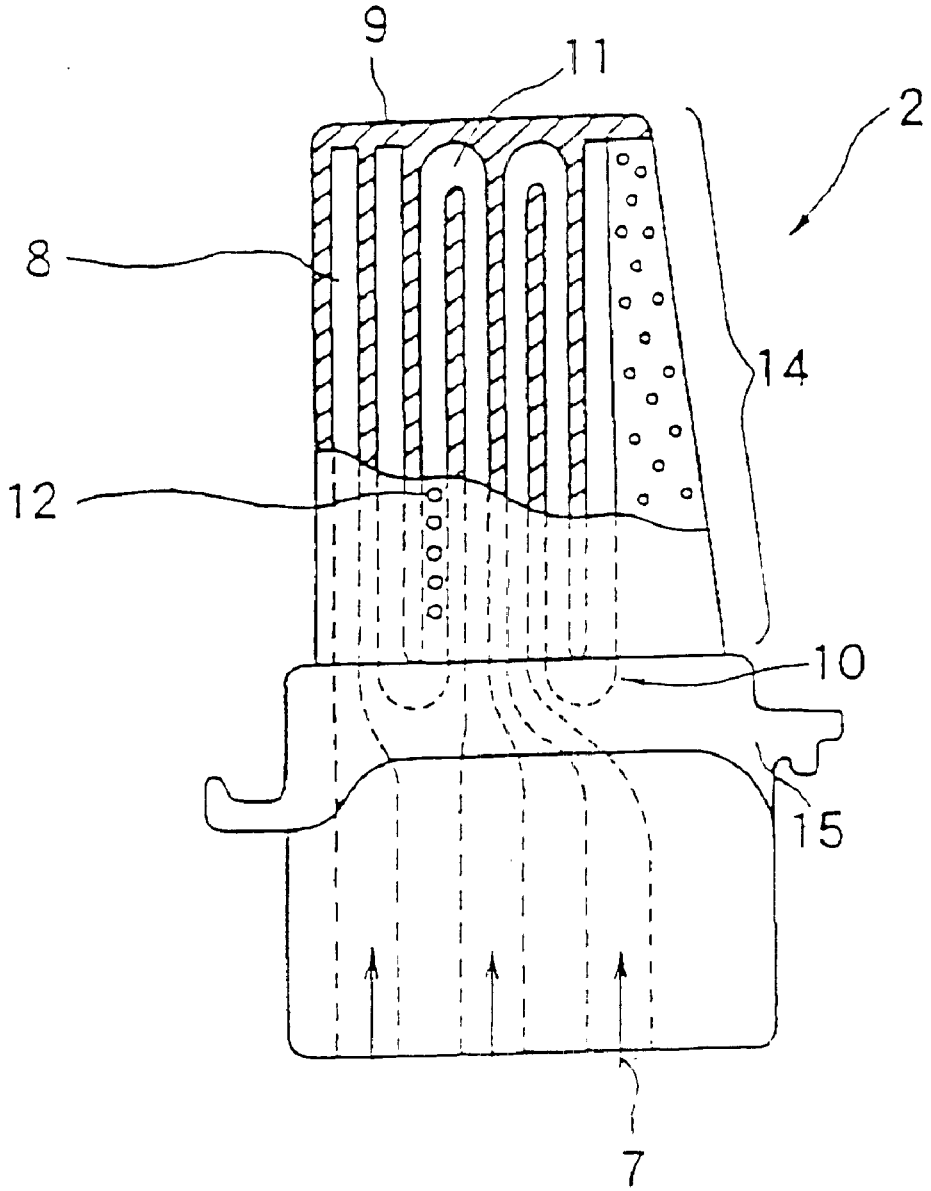
Fig. 6 (Prior Art)
FIG. 6 is a longitudinal cross sectional view showing a main structure of a prior art turbine moving blade.

FIG. 3 is an enlarged side view showing a thinned portion of a shroud adjacent to a turbine stationary blade of the second embodiment according to the present invention and FIG. 4 is an explanatory view showing a temperature difference between metal temperature of a trailing edge portion and that of the shroud of the turbine stationary blade of FIG. 3.

Figure 7:
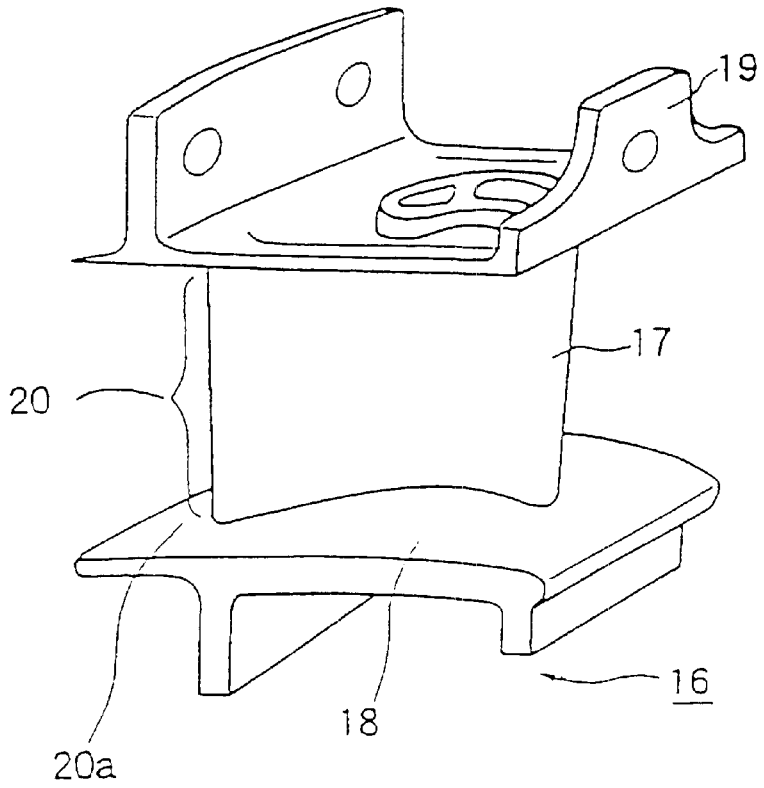
Fig. 7 (Prior Art)
FIG. 7 is a perspective view showing a main structure of a prior art turbine stationary blade.
Figure 8:
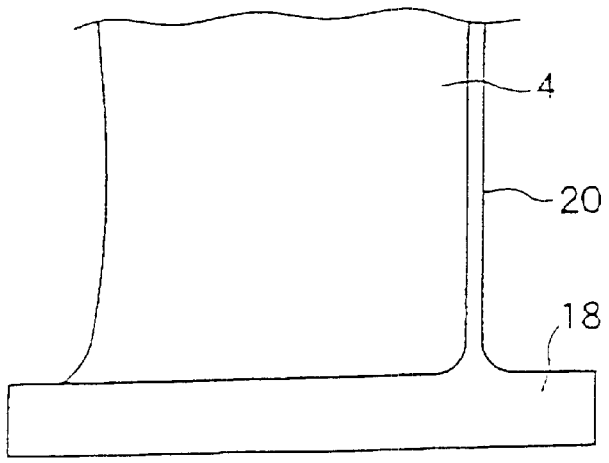
Fig. 8 (Prior Art)
FIG. 8 is an enlarged view of a part of the turbine stationary blade of FIG. 7.
Figure 9:
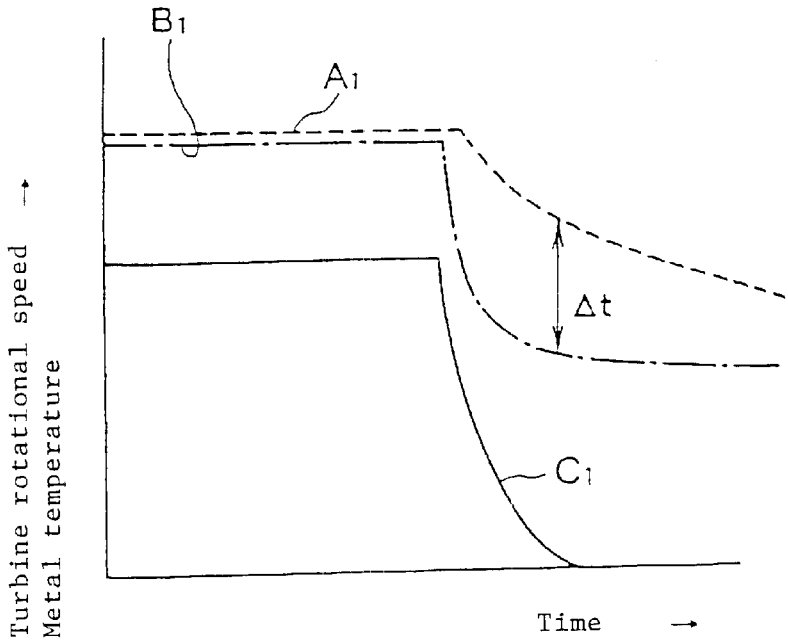
Fig. 9 (Prior Art)
FIG. 9 is a qualitative explanatory view showing a metal temperature behavior due to a thickness difference between thickness of a turbine moving blade trailing edge portion and that of a platform in the prior art.
Figure 10:
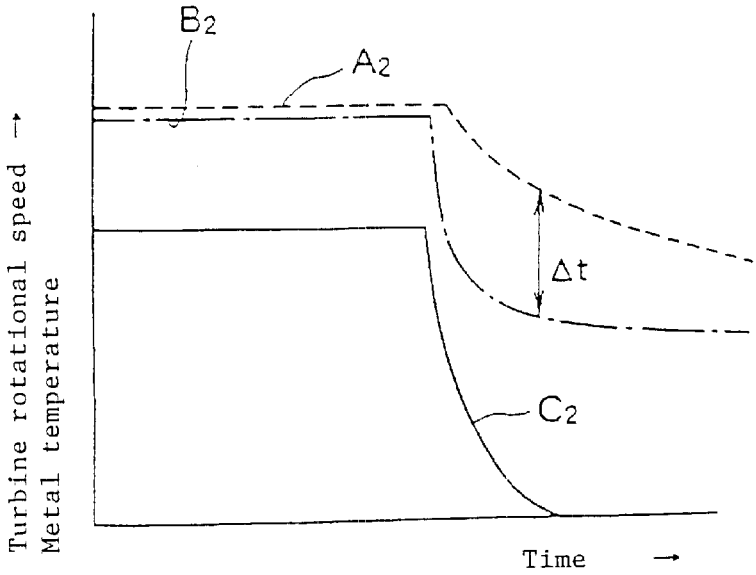
Fig. 10 (Prior Art)
FIG. 10 is a qualitative explanatory view showing a metal temperature behavior due to a thickness difference between thickness of a turbine stationary blade trailing edge portion and that of a shroud in the prior art.

In the present embodiment, like in the prior art case shown in FIG. 7, the turbine stationary blade 4 comprises a blade profile portion for guiding a combustion gas flow, an outer shroud 19 (FIG. 7) on the outer side of the blade and an inner shroud 18 on the inner side of the blade.

It is to be noted that although FIG. 3 shows the inner shroud 18 only, the present embodiment is applicable both to the inner shroud 18 and to the outer shroud 19 and, with respect to the outer shroud 19, the inner shroud 18 shown in FIG. 3 is to be read as the outer shroud 19.

In the present embodiment, thinned portions 21 of shroud metals of the inner shroud 18 and the outer shroud 19, respectively, are provided in joint adjacent portions 20*a* in which a blade trailing edge portion 20 of the turbine stationary blade 4 is jointed to the inner shroud 18 and the outer shroud 19, respectively, so that a metal thickness there is thinned to approach to a metal thickness of the blade trailing edge portion 20 of the turbine stationary blade 4. The thinned portion 20*a* may be formed so that the shroud metal thickness increases smoothly toward a combustion gas flow upstream side from the blade trailing edge portion 20 or the thinned portion 20*a* is provided only partially in the joint adjacent portion 20*a,* as the case may be.

According to the present embodiment, the shroud metal thickness is made approximately same as the metal thickness of the blade trailing edge portion 20 in each of the joint adjacent portions 20*a* in which the blade trailing edge portion 20 is jointed to the inner shroud 18 and the outer shroud 19, respectively, and thereby the thermal capacity difference between the blade trailing edge portion 20 and the inner shroud 18 or the outer shroud 19 in the respective joint adjacent portions 20*a* is reduced and a uniform metal temperature can be maintained in a steady operation time.

Further, even in a variation time of combustion gas flow condition following a gas turbine start or stop, the temperature difference between the blade trailing edge portion 20 and the inner shroud 18 or the outer shroud 19 can be reduced. Hence, thermal stress caused by the temperature difference can be reduced and life of the turbine blade can be enhanced greatly.

In FIG. 4 in which a metal temperature behavior in the present embodiment is shown qualitatively, in the area where gas turbine rotational speed $C_2$ is reduced for stop of the gas turbine, temperature difference $\Delta t$ between stationary blade trailing edge portion metal temperature $B_2$ and shroud metal temperature $A_2$ of the inner shroud 18 and the outer shroud 19 is small and the thermal capacity is nearly same in these respective portions. Accordingly, even in a transitional behavior change, such as stop of gas turbine, the thermal stress caused by the temperature difference can be reduced and the reliability can be enhanced remarkably.

In the above, while the invention has been described with respect to the embodiments as illustrated, the invention is not limited thereto but, needless to mention, may be added with various modifications in the concrete construction thereof within the scope of the appended claims.

For example, while the invention has been described based on a cooled type blade of the moving blade and the stationary blade in the mentioned embodiments, the construction for reducing the thermal stress by employing the cut-away portion or the thinned portion is not limited to the cooled type blade but may be applied to a non-cooled type blade.

What is claimed is:

1. A turbine blade comprising a moving blade joint adjacent portion between a moving blade trailing edge portion and a platform, wherein said platform in said moving blade joint adjacent portion is partially cut away and a remaining thickness of said platform so cut away is approximately the same as a thickness of said moving blade trailing edge portion.

2. A turbine blade comprising stationary blade inner and outer joint adjacent portions between a stationary blade trailing edge portion and an inner shroud and between said stationary blade trailing edge portion and an outer shroud, respectively, wherein each of said inner shroud in said stationary blade inner joint adjacent portion and said outer shroud in said stationary blade outer joint adjacent portion is thinned and a remaining thickness each of said inner shroud and said outer shroud so thinned is approximately the same as a thickness of said stationary blade trailing to edge portion.

3. Gas turbine equipment comprising a moving turbine blade and a stationary turbine blade, wherein said moving turbine blade comprises a moving blade joint adjacent portion between a moving blade trailing edge portion and a platform, wherein said platform in said moving blade joint adjacent portion is partially cut away and a remaining thickness of said platform so cut away is approximately the same as a thickness of said moving blade trailing edge portion, and wherein said stationary turbine blade comprises said turbine blade of claim 2.

4. A turbine blade comprising at least one blade joint adjacent portion between a blade trailing edge portion and a platform or inner or outer shroud, wherein said platform or inner or outer shroud, in said at least one joint adjacent portion, is thinner than other portions of said platform or inner or outer shroud such that a thickness of said platform or inner or outer shroud at said joint adjacent portion is approximately the same as a thickness of said blade trailing edge portion.

5. The turbine blade of claim 4, wherein said turbine blade is a moving blade, said blade trailing edge portion is a moving blade trailing edge portion, and said at least one joint adjacent portion is a moving blade joint adjacent portion between said moving blade trailing edge portion and said platform.

6. The turbine blade of claim 4, wherein said turbine blade is a stationary blade, said blade trailing edge portion is a stationary blade trailing edge portion, and said at least one joint adjacent portion comprises stationary blade inner and outer joint adjacent portions between said stationary blade trailing edge portion and said inner shroud and between said stationary blade trailing edge portion and said outer shroud.

* * * * *